US006239069B1

(12) United States Patent
Asai

(10) Patent No.: US 6,239,069 B1
(45) Date of Patent: May 29, 2001

(54) PROTECTING FILM FOR SUBLIMATION TRANSFER IMAGE RECEIVER ON OF AND PROTECTED SUBLIMATION TRANSFER IMAGE RECEIVER

(75) Inventor: Haruo Asai, Ohtsu (JP)

(73) Assignee: Toyo Boseki Kabushiki Kaisha, Osaka-fu (JP)

( * ) Notice: Subject to any disclaimer, the term of this patent is extended or adjusted under 35 U.S.C. 154(b) by 0 days.

(21) Appl. No.: 09/215,782

(22) Filed: Dec. 18, 1998

(30) Foreign Application Priority Data

Dec. 19, 1997 (JP) ..... 9-351101

(51) Int. Cl.[7] ..... B41M 5/035; B41M 5/38

(52) U.S. Cl. ..... 503/227; 428/195; 428/413; 428/423.1; 428/474.4; 428/480; 428/500

(58) Field of Search ..... 8/471; 503/227; 428/195, 913, 914, 480, 474.4, 423.1, 413, 500

(56) References Cited

U.S. PATENT DOCUMENTS

| | | | | |
|---|---|---|---|---|
| 5,547,534 | | 8/1996 | Conforti et al. | 156/230 |
| 5,668,081 | | 9/1997 | Simpson et al. | 503/227 |
| 5,759,954 | * | 6/1998 | Taguchi et al. | 503/227 |
| 6,043,194 | * | 3/2000 | Saito et al. | 503/227 |

FOREIGN PATENT DOCUMENTS

| | | | | |
|---|---|---|---|---|
| 0 715 965 A1 | | 6/1996 | (EP) . | |
| 8-300837 | * | 11/1996 | (JP) | 503/227 |
| WO 96/14993 | | 5/1996 | (WO) . | |
| WO 98/07577 | | 2/1998 | (WO) . | |

* cited by examiner

*Primary Examiner*—Bruce H. Hess
(74) *Attorney, Agent, or Firm*—Morrison & Foerster LLP

(57) ABSTRACT

A protecting film for sublimation transfer image receiver, comprising a heat resistant substrate and an image protecting layer formed on said heat resistant substrate, the layer comprising at least one member selected from the group consisting of (a) a resin having a glass transition temperature of not less than 68° C. and (b) a resin having an alicyclic structure in the resin skeleton. The image protecting layer used in the present invention shows superior image durability and image preservation property, wherein highly sensitive, high quality images are maintained for a long time.

3 Claims, No Drawings

PROTECTING FILM FOR SUBLIMATION TRANSFER IMAGE RECEIVER ON OF AND PROTECTED SUBLIMATION TRANSFER IMAGE RECEIVER

TECHNICAL FIELD OF THE INVENTION

The present invention relates to a film for protecting images on a sublimation transfer image receiver used in combination with a heat transfer sheet containing a sublimation dye, a method for protecting images on an image receiver using said film, and a sublimation transfer image receiver protected by an image protecting layer of said film.

BACKGROUND OF THE INVENTION

A sublimation type heat transfer method provides printed images by heating, with a thermal head and the like, a heat transfer sheet coated with a sublimation dye to transfer the sublimation dye to a sublimation transfer image receiver that comes into contact with the heat transfer sheet.

The dyeable resin to be used for the dyeable layer of the above-mentioned sublimation transfer image receiver mainly contains a saturated polyester, as disclosed in Japanese Patent Unexamined Publication Nos. 57-107885, 60-64899, 61-258790, 62-105689 and the like. Japanese Patent Unexamined Publication No. 3-136896 discloses an image receiver characterized by a multilayer laminate.

When a saturated polyester is used as a resin for a dyeable layer, high quality images having superior color density, tone and color reproducibility can be obtained. Inasmuch as recorded images are closely related to the dye preservation state, considerably high preservation performance has become attainable by carefully designing a resin for a dyeable layer, though still below the image preservation performance of photographs.

When compared to photographs, moreover, this construction, wherein a dye image receiving layer is formed on the surface, is inherently associated with a problem that images are disturbed by a long term preservation.

This problem can be resolved by the use of a dyeable resin having a higher preservation performance, but the dye sensitivity and printing speed decrease when the dyeable resin is used. Conventional multilayer laminates aim at improving releasing property by preventing heat-melting caused by heating with a thermal head.

In addition, a method for protecting images by, after dyeing, superimposing a transparent or semitransparent film having a heat-melt layer on a sublimation transfer image receiver and melt-adhering the heat-melt layer to the dyeable layer has been proposed (Japanese Patent Unexamined Publication Nos. 1-237193, 3-70637, 4-15118 and 4-52223).

Yet, the image durability afforded by these methods is insufficient.

It is therefore an object of the present invention to provide a protecting film for sublimation transfer image receiver, which is capable of resolving the above-mentioned problems and improving image durability while maintaining highly sensitive, high quality images for a long time.

It is another object of the present invention to provide a method for protecting images on a sublimation transfer image receiver using this film.

It is yet another object of the present invention to provide a sublimation transfer image receiver protected by an image protecting layer of said film.

SUMMARY OF THE INVENTION

The present invention now submits the use of a resin having a glass transition temperature of not less than 68° C. and/or a resin having an alicyclic skeleton in the main chain, as a component of a layer protecting the images on a sublimation transfer image receiver.

Accordingly, the present invention provides the following films, protection methods and sublimation transfer image receivers.

(1) A protecting film for sublimation transfer image receiver, comprising a heat resistant substrate and an image protecting layer formed on said heat resistant substrate, the layer comprising at least one member selected from the group consisting of (a) a resin having a glass transition temperature of not less than 68° C. and (b) a resin having an alicyclic structure in the resin skeleton.

(2) The protecting film for sublimation transfer image receiver of (1) above, wherein at least one of the resin (a) and the resin (b) is a member selected from the group consisting of a polyester resin, a polyurethane resin, a polyamide resin, an epoxy resin and an acrylic resin.

(3) The protecting film for sublimation transfer image receiver of (2) above, wherein at least one of the resin (a) and the resin (b) is a member selected from the group consisting of a polyester resin, a polyurethane resin and a polyamide resin.

(4) A method for protecting a sublimation transfer image receiver, comprising superimposing an image protecting layer of the protecting film for sublimation transfer image receiver of (1) above on a dyeable layer of the sublimation transfer dye image receiver, and melt-adhering the image protecting layer to the dyeable layer by heating.

(5) A sublimation transfer image receiver comprising a substrate, a dyeable layer formed on said substrate and an image protecting layer, the protecting layer comprising at least one member selected from the group consisting of (a) a resin having a glass transition temperature of not less than 68° C. and (b) a resin having an alicyclic structure in the resin skeleton.

DETAILED DESCRIPTION OF THE INVENTION

In the present invention, by a sublimation transfer image receiver is meant a recording material to afford images by transfer of a sublimation dye to a dyeable layer. By a dyeable layer is meant a layer on which a sublimation dye is transferred to form images, and by an image protecting layer is meant a transparent or semitransparent layer formed on a dyeable layer to protect images formed on the dyeable layer from staining, light and the like.

The resin which forms the image protecting layer in the present invention comprises either resin (a) having a glass transition temperature (Tg) of not less than 68° C. or resin (b) having an alicyclic structure in the resin skeleton (main chain).

The above-mentioned Tg is preferably not less than 70° C. and particularly preferably not less than 73° C.

When resin (b) is used, Tg is preferably not less than 30° C., more preferably not less than 40° C. Resin (a) having Tg of less than 68° C. or resin (b) having Tg of less than 30° C. causes severe blocking of coat film and makes an image receiving paper practically useless. In addition, it shows inferior heat resistance that prevents exertion of fine image durability.

While the upper limit of Tg is not particularly set, it is preferably 100° C., particularly preferably 85° C., in view of fragility of the protecting layer film.

The number of carbon atoms of the alicyclic unit constituting the alicyclic skeleton of resin (b) is 3–20, preferably 6–16. Examples of said alicyclic unit include saturated alicyclic unit (e.g., cycloparaffin), alicyclic unit having unsaturated bond (e.g., cycloalkene and cycloalkyne), and the like, which may be monocyclic or polycyclic (e.g., dicyclic and tricyclic).

Specific examples include cyclohexane, cyclodecane, decaline, hydrogenated bisphenol A, tricyclodecane and the like.

The proportion of the alicyclic skeleton in the resin (b) is preferably not less than 15 mol %, more preferably not less than 30 mol %.

While the kind of the resin (a) and resin (b) is not particularly limited, it is preferably polyester resin, polyurethane resin, polyamide resin, epoxy resin or acrylic resin, more preferably polyester resin, polyurethane resin or polyamide resin, and particularly preferably polyester resin and polyurethane resin.

When polyester is used as the resin (b), it is preferably a polyester resin wherein a monomer having an alicyclic skeleton has been used as the dicarboxylic acid component and/or diol component.

The acid component and/or glycol component to be contained in the monomer having an alicyclic skeleton in the present invention is preferably contained in a proportion of not less than 15 mol %, more preferably not less than 30 mol %.

The alicyclic dicarboxylic acid usable in the present invention may be, for example, cyclohexanedicarboxylic acid, tricyclodecanedicarboxylic acid, decalinedicarboxylic acid and the like, which may be methyl esterified or an acid anhydride thereof.

The diol component having an alicyclic skeleton may be, for example, tricyclodecanediol, tricyclodecanedimethylol, cyclohexanediol, cyclohexanedimethanol, hydrogenated bisphenol A, ethylene oxide and propylene oxide adducts of hydrogenated bisphenol A and the like. These may be used alone or in combination.

Other components usable for obtaining the polyester resin of the present invention include, as dicarboxylic acid, aromatic dicarboxylic acids (e.g., terephthalic acid, isophthalic acid, orthophthalic acid, naphthalene dicarboxylic acid, biphenyl dicarboxylic acid, diphenic acid, sulfoterephthalic acid, 5-sulfoisophthalic acid, 4-sulfophthalic acid, 4-sulfonaphthalene-2,7-dicarboxylic acid, 5-(4-sulfophenoxy)isophthalic acid, sulfoterephthalic acid and the like), metal salts thereof, ammonium salts thereof, aromatic oxycarboxylic acids (e.g., p-oxybenzoic acid and p-(hydroxyethoxy)benzoic acid), and the like; and, as aliphatic dicarboxylic acid, succinic acid, adipic acid, azelinic acid, sebacic acid, dodecanedionic acid, dimer acid and the like.

Examples of unsaturated dicarboxylic acid include fumaric acid, maleic acid, anhydrous maleic acid, itaconic acid, sitraconic acid and the like. Also exemplified are tri- and tetracarboxylic acids such as trimellitic acid, pyrromellitic acid and the like.

With regard to the glycol component, aliphatic glycol may be, for example, ethylene glycol, 1,2-propylene glycol, 1,3-propanediol, 1,4-butanediol, 1,5-pentanediol, neopentyl glycol, 1,6-hexanediol, 3-methyl-1,5-pentanediol, 1,9-nonanediol, 2-ethyl-2-butylpropanediol, neopentyl glycol ester of hydroxypivaphosphoric acid, dimethylolheptane, 2,2,4-trimethyl-1,3-pentanediol and the like.

The ether bond-containing glycol may be diethylene glycol, triethylene glycol, dipropylene glycol, polyethylene glycol, polypropylene glycol, polytetramethylene glycol, neopentyl glycol-ethylene oxide adduct, neopentyl glycol-propylene oxide adduct and the like, which are selected on demand.

The aromatic group-containing glycol is exemplified by paraxylene glycol, methaxylene glycol, orthoxylene glycol, 1,4-phenylene glycol, 1,4-phenylene glycol-ethylene oxide adduct, bisphenol A, glycols obtained by adding one to several moles of ethylene oxide or propylene oxide to two phenolic hydroxyl groups of bisphenol, such as bisphenol A-ethylene oxide and -propylene oxide adducts, and the like.

The polyurethane resin is exemplified by one comprising polyol, an organic diisocyanate compound, and, where necessary, a chain extender having active hydrogen, a molecular weight of 500–100000 and urethane bond content of 500–4000 equivalents/$10^6$ g. Examples of polyol include polyester polyol, polyether, polycarbonate, polyacrylate and the like, with preference given to polyester polyol. The alicyclic skeleton may be contained in polyol or chain transfer agent (chain extender).

The polyester polyol is produced from a dicarboxylic acid component and a compound exemplified as a glycol component in the explanation of the polyester resin. Preferred is a polyester polyol having hydroxyl groups on both terminals or side chain and a molecular weight of 500–10000.

The organic diisocyanate compound may be, for example, hexamethylene diisocyanate, tetramethylenediisocyanate, 3,3'-dimethoxy-4,4'-biphenylene diisocyanate, p-xylene diisocyanate, m-xylene diisocyanate, 1,3-diisocyanate methylcyclohexane, 4,4'-diisocyanate dicyclohexane, 4,4'-diisocyanate cyclohexylmethane, isophorone diisocyanate, 2,4-tolylene diisocyanate, 2,6-tolylene diisocyanate,p-phenylene diisocyanate, diphenylmethane diisocyanate, m-phenylene diisocyanate, 2,4-naphthalene diisocyanate, 3,3'-dimethylbiphenyl-4,4'-diisocyanate, 4,4'-diisocyanatediphenyl ether, 1,5-naphthalene diisocyanate and the like.

The chain extender having active hydrogen includes glycols such as ethylene glycol, propylene glycol, neopentyl glycol, 2,2-diethyl-1,3-propanediol, diethylene glycol, spiroglycol, polyethylene glycol and the like, and amines such as hexamethylenediamine, propylenediamine and the like.

The above-mentioned polyurethane resin is produced by a known method in a solvent at a reaction temperature of 20–150° C. in the presence or absence of a catalyst. The usable solvent may be ketones such as methyl ethyl ketone, methyl isobutyl ketone, cyclohexanone and the like; aromatic hydrocarbons such as toluene and xylene; and esters such as ethyl acetate, butyl acetate and the like. The catalyst to accelerate the reaction may be amines, organic tin compounds and the like.

The resin (a) and resin (b) in the present invention preferably have a reduced viscosity of 0.05–1.5 dl/g, more preferably 0.10–1.3 dl/g. When the reduced viscosity is less than 0.05 dl/g, the strength that an image protecting layer is required to have becomes low. When it exceeds 1.5 dl/g, the viscosity of a solution to be applied to a substrate becomes too high, causing difficult handling.

For an improved image durability, the resin (a) and resin (b) of the present invention may be thermally cured or crosslinked. The curing agent for thermal curing may be silicone resin, melamine resin, phenol-formaline resin, epoxy resin, isocyanate resin and the like. The crosslinking is performed by ionic crosslinking, radiation crosslinking and the like.

Other resin may be concurrently used with the above-mentioned resin (a) and/or resin (b) to be used for an image protecting layer. Usable resins include, for example, polyvinyl resin, polycarbonate resin, polyacrylic resin, polyester resin, polymethacrylate resin, polyolefin resin, cellulose resin, polyether resin, vinyl chloride resin, polyurethane resin, polyamide resin, epoxy resin, polyacetal resin, polystyrene resin and modified resin thereof.

Moreover, paraffin wax, microcrystalline wax, carnauba wax, bee wax, chlorinated paraffin petroleum resin, low molecular polyethylene, oils (e.g., linseed oil, mineral oil and the like), inorganic powder, organic powder and the like may be added.

The resin (a) and/or resin (b) are/is contained in the resin constituting the image protecting layer in a proportion of preferably at least 1 wt %, more preferably 5–100 wt %.

The thickness of the image protecting layer is not particularly limited, but it is typically about 0.01–20 $\mu$m.

The kind of substrate of the protecting film for sublimation transfer image receiver is not particularly limited as long as it has heat resistance, and it may be paper, synthetic paper, various films, various sheets and the like. For example, it is a heat resistant plastic film substrate and paper, metal foil and the like, typically exemplified by polyester, polycarbonate, polyarylate, poly(ether sulfone), polyamide, polyamide, poly(amide imide), polyfluoroethylene and the like, that have smooth surface, satinized surface or a surface after a releasing treatment or a metal treatment with Al, Zn, Cv and the like. Alternatively, it may be a substrate consisting of the above-mentioned substrates adhered to each other as necessary. The thickness of the substrate is 5–100$\mu$, preferable 8–50$\mu$, which may be set in consideration of easy handling and easy melt-adhesion on heating.

A resin containing resin (a) and/or resin (b), which forms an image protecting layer is applied to a heat resistant substrate to produce a protecting film for sublimation transfer image receiver. To be specific, the resin (a) and/or resin (b), and other resin to be added as necessary, additive and the like are dissolved in a solvent and applied. Alternatively, it can be applied in the form of a nonaqueous dispersion, aqueous dispersion or an aqueous solution without solvent. The solution or dispersion generally has a solid content of about 1–70 wt % when applying to the substrate.

The protecting film for sublimation transfer image receiver of the present invention may have a releasing layer formed between the heat resistant substrate and image protecting layer, which releasing layer containing silicone resin, fluororesin and the like.

Also, it is possible to form an adhesive layer on the image protecting layer in an attempt to improve adhesion to the image receiving layer.

Moreover, a heat resistant back coating layer containing a curing agent of a thermal cuing type or photocuring type may be formed on the substrate on the opposite side from the image protecting layer. These releasing layer, adhesive layer and heat resistant backcoat layer can be used for a heat melt transfer ink ribbon sheet, a sublimation heat transfer ink ribbon sheet and the like.

The dyeable resin to be used for the image receiving paper of the sublimation transfer image receiver is not particularly limited, and polyvinyl resin, polycarbonate resin, polyacrylic resin, polyester resin, polymethacrylate resin, polyolefin resin, cellulose resin, polyether resin, polyvinyl chloride and its modified resin and the like may be used alone or in combination.

The image receiver of the present invention can contain ultraviolet absorbers such as benzophenone type ultraviolet absorber (e.g., hydroxy-benzophenone, dihydroxybenzophenone and the like), and benzotriazol type ultraviolet absorber, salicylic acid derivative type ultraviolet absorber, antioxidants and the like, for an improved photoresistance of the recorded images. These compounds may be added to either the image protecting layer or image receiving layer, or both.

The substrate to be used for the sublimation transfer image receiver is not particularly limited and is exemplified by paper, synthetic paper, various films, various sheets, metal boards, glass boards, cloth, nonwoven fabric and the like.

In the protecting film for sublimation transfer image receiver of the present invention, resin (a) and/or resin (b) may be used to replace part of the dye layer of the heat transfer sheet, to which a sublimation dye of yellow, cyan, magenta or black has been applied. It may be used upon incorporation into part of a heat transfer sheet or independently as a protecting film for a sublimation transfer image receiver.

The image protecting layer of the inventive protecting film for sublimation transfer image receiver is superimposed on the dyeable layer of a sublimation dye image receiver and heated with a thermal head, laser beam and the like to melt-adhere the image protecting layer to the dyeable layer.

The sublimation dye image receiver thus obtained is a laminate of the specific resin (a) and/or resin (b) laminated on the dyeable layer.

The present invention is explained in the following by way of examples, to which the present invention is not particularly limited. In the examples, "part" means "part by weight" and "%" means "wt %" unless otherwise specified. Each measurement item followed the method below.

(1) Reduced viscosity (dl/g)

A polyester resin (0.01 g) was dissolved in a mixed solvent (25 ml)of phenol/tetrachloroethane (weight ratio 6/4) and measured at 30° C.

(2) Glass transition temperature (Tg)

Measured using a differential scanning calorimeter (DSC) at a temperature elevating rate of 20° C./min. A crimped sample (5 mg) was placed in a container with an aluminum press lid and measured.

(3) Density evaluation of printed image

An image receiving sheet (sublimation transfer image receiver) and a heat transfer sheet were superimposed in such a manner that the dyeable layer and the coloring material layer (dye layer) came into contact, and heated from the substrate side of the heat transfer sheet with a thermal head at head output 0.7 W/dot, head heating time 8 mS and dot density 3 dots/mm to transfer cyan dye in the coloring material layer to the dyeable layer. The density of the obtained transferred image was measured by a reflection densitometer (DM-600, manufactured by DAINIPPON SCREEN MFG. CO., LTD.)

(4) Evaluation of heat resistance (darkening or fading of color)

The image density of an image receiver, to which cyan dye had been transferred, was measured. This was left standing (aging) in a dark place at 60° C. for 168 hours (heat resistance test). Then, the image density was measured and compared with the density before the heat resistance test and expressed in dye retention percentage (%).

(5) Evaluation of photoresistance

An image receiver, to which cyan dye had been transferred, was exposed to xenone lamp irradiation at 40° C. and energy therefrom of 67.0 KJ/$m^2$ (photoresistance test). Then, the dye density was measured and compared with the density before the photoresistance test and expressed in dye density retention percentage (%).

$$\text{dye density retention (\%)} = \frac{\text{density after photoresistance test}}{\text{density before photoresistance test}} \times 100$$

(6) Resistance to plasticizer

A 50 μm thick vinyl chloride film (1 $cm^2$) was placed in contact with the surface of an image receiving layer, to which cyan dye had been transferred, and a load of 5 g was applied to the vinyl chloride film. After allowing the film to stand at 40° C. for 24 hours, cissing of the cyan dye and a trace of the film were checked. The film free of change such as cissing or a trace of the film on the surface of the image receiving layer after aging was rated as ○, the film with a trace of the film, though no change in color, was rated as Δ and the film with color change and a trace of the film was rated as X.

(7) Resistance to fingerprint

Thumb was pressed hard against an image receiving layer, to which cyan dye had been transferred, to leave fingerprint on the surface of the image. After allowing the film to stand at 40° C. for 48 hours, aggregation of cyan dye, cissing of the cyan dye and a trace of fingerprint were checked. The film free of change such as cissing or a trace of fingerprint on the surface of the image receiving layer after aging was rated as ○, the film with a trace of fingerprint, though no change in color, was rated as Δ and the film with color change and a trace of fingerprint was rated as X.

Production of Polyester Resin for Image Protecting Layer

Dimethyl terephthalate (291 parts), dimethyl isophthalate (291 parts),1,4-cyclohexanedimethanol (100 parts), ethylene glycol (229 parts) and tetra-n-butyl titanate (0.5 part) were charged in a stainless steel autoclave equipped with a stirrer, a thermometer and a partial refluxing condenser, and subjected to ester interchange at 160–220° C. over 4 hours. The reaction mixture was heated to 255° C. and gradually depressurized. The mixture was reacted under reduced pressure at 0.2 mmHg for 1.5 hours to give polyester resin A. The obtained polyester A was pale-yellow and transparent and had a reduced viscosity of 0.45 dl/g and Tg of 70° C. The polyester resins B–E obtained by the same method are shown in Table 1.

Coating of Image Protecting Layer

The obtained polyester resin A was diluted with a mixed solution of methyl ethyl ketone:tetrahydrofuran=b 1:1to give a 5% solution. This solution was applied to a 5 μm thick transparent PET film (manufactured by Toyo Boseki Kabushiki Kaisha), to which a silicone releasing agent had been applied in advance, with a wire bar, so that a 1.5 μm thick dry film could be obtained, whereby an image protecting layer was formed. The evaluation results of the above-mentioned (1)–(7) are shown in Table 2.

EXAMPLE 1

As a resin for a dyeable layer, VYLON 200 (manufactured by Toyo Boseki Kabushiki Kaisha) was diluted with a mixed solvent of methyl ethyl ketone:toluene=1:1 to give a 20% solution. To this solution was added epoxy modified silicone oil (KF-102, manufactured by Shin-Etsu Chemical Co., Ltd.) in a proportion of 10% of the above-mentioned resin component. This solution was applied to a 150 μm thick synthetic paper (Yupo PPG-150, manufactured by Oji Yuka Co., Ltd.) with a wire bar, so that a 4 μm thick dry film could be obtained. This sheet was dried at 120° C. for 30 minutes to give a dyeable layer (dye receiving layer).

According to the above-mentioned method, a dye was transferred to the obtained dyeable layer, and the image protecting layer formed on the above-mentioned transparent PET film was transferred to the dyeable layer by heating with a thermal head at head output 0.7 W/dot, head heating time 8 mS and dot density 3 dots/mm. The adhesion of the resulting image protecting layer to the dyeable layer was extremely fine.

EXAMPLES 2 and 3

Using polyester resins B and C and in the same manner as in Example 1, dyeable layers were formed.

Comparative Example 1

Using polyester resin D and in the same manner as in Example 1 ,an image receiver was formed.

Comparative Example 2

Using polyester resin E and in the same manner as in Example 1, a dyeable layer was formed.

Comparative Example 3

In the same manner as in Example 1, a dyeable layer was formed but an image protecting layer was not.

TABLE 1

| Resin | A | B | C | D | E |
|---|---|---|---|---|---|
| Terephthalic acid | 65 | 50 | 50 | 65 | 50 |
| Isophthalic acid | 35 | 50 | 50 | 35 | 50 |
| Ethylene glycol | 65 | | 10 | 65 | 30 |
| Neopentyl glycol | | 40 | | | 60 |
| 1,4-cyclohexane dimethanol | 35 | 60 | | 35 | 10 |
| Tricyclodecane dimethylol | | | 90 | | |
| Glass transition temperature (° C.) | 70 | 75 | 85 | 25 | 65 |
| Reduced viscosity (dl/g) | 0.45 | 0.50 | 0.25 | 0.05 | 0.50 |

TABLE 2

| | Ex. 1 | Ex. 2 | Ex. 3 | Co. Ex. 1 | Co. Ex. 2 | Co. Ex. 3 |
|---|---|---|---|---|---|---|
| Resin for image protecting layer | A | B | C | D | E | none |
| Dye density | 2.2 | 2.2 | 2.2 | 2.2 | 2.2 | 1.2 |
| Heat resistance | 98 | 100 | 95 | 30 | 85 | 50 |
| Photoresistance | 90 | 93 | 92 | 40 | 60 | 50 |
| Resistance to plasticizer | ○ | ○ | ○ | X | X | Δ |
| Resistance to fingerprint | ○ | ○ | ○ | X | X | Δ |

The image protecting layer used in the present invention shows superior image durability and image preservation property, wherein highly sensitive, high quality images are maintained for a long time. Thus, the sublimation heat sensitive recording paper having this image protecting layer is industrially useful.

This application is based on application No. 351101/1997 filed in Japan, the content of which is incorporated hereinto by reference.

What is claimed is:

1. A protecting film for sublimation transfer image receiver, comprising a heat resistant substrate and an image protecting layer formed on said heat resistant substrate, the layer comprising at least one member selected from the group consisting of (a) a resin having a glass transition temperature of not less than 68° C. and (b) a polyester resin having a tricyclodecane structure in the resin skeleton.

2. The protecting film for sublimation transfer image receiver of claim 1, wherein at least one of the resin (a) and the resin (b) is a member selected from the group consisting of a polyester resin, a polyurethane resin, a polyamide resin, an epoxy resin and an acrylic resin.

3. The protecting film for sublimation transfer image receiver of claim 2, wherein at least one of the resin (a) and the resin (b) is a member selected from the group consisting of a polyester resin, a polyurethane resin and a polyamide resin.

* * * * *

UNITED STATES PATENT AND TRADEMARK OFFICE

CERTIFICATE OF CORRECTION

PATENT NO. : 6,239,069 B1
DATED : May 29, 2001
INVENTOR(S) : Haruo Asai

It is certified that error appears in the above-identified patent and that said Letters Patent is hereby corrected as shown below:

Title page,
Item [54], change the title to read -- PROTECTING FILM FOR SUBLIMATION TRANSFER IMAGE RECEIVER AND PROTECTED SUBLIMATION TRANSFER IMAGE RECEIVER --.

Signed and Sealed this

Fifth Day of November, 2002

*Attest:*

*Attesting Officer*

JAMES E. ROGAN
*Director of the United States Patent and Trademark Office*